United States Patent [19]

Little

[11] 4,215,884

[45] Aug. 5, 1980

[54] TOUCH LATCH

[75] Inventor: Carl H. Little, St. Louis, Mo.

[73] Assignee: Weber-Knapp Company, Jamestown, N.Y.

[21] Appl. No.: 1,867

[22] Filed: Jan. 8, 1979

[51] Int. Cl.[2] ..... E05C 3/14

[52] U.S. Cl. ..... 292/220; 292/DIG. 4

[58] Field of Search ..... 292/DIG. 4, 209, 228, 292/78, 79, DIG. 15, 220

[56] References Cited

U.S. PATENT DOCUMENTS

| | | | |
|---|---|---|---|
| 2,941,831 | 6/1960 | Borsani | 292/79 |
| 3,189,374 | 6/1965 | Mertes | 292/80 |

FOREIGN PATENT DOCUMENTS

| | | | |
|---|---|---|---|
| 442795 | 2/1936 | United Kingdom | 292/79 |
| 1188996 | 4/1970 | United Kingdom | 292/DIG. 4 |

*Primary Examiner*—Richard E. Moore

*Attorney, Agent, or Firm*—Bean, Kauffman & Bean

[57] ABSTRACT

In a touch latch mechanism of the type adapted for use in latching a pair of members upon relative convergent movement thereof from a remote position into an adjacent position and for releasing the members from their adjacent position for relative divergent movement towards their remote position upon further movement of the members in the direction of converging movement beyond the adjacent position, the improvement wherein the latch mechanism includes a catch plate cooperating with a novel keeper mechanism characterized as having a resiliently deformable and pivotally supported keeper element.

4 Claims, 5 Drawing Figures

TOUCH LATCH

BACKGROUND OF THE INVENTION

The present invention relates to a touch latch mechanism or spring catch of the general type adapted to automatically latch doors, drawers, windows or the like in a closed position and thereafter permit unlatching thereof solely in response to pressure exerted on the closed door. More specifically, the present invention relates to improvements in touch latch mechanisms of the general type described in U.S. Pat. No. 2,941,831, wherein a keeper mechanism includes a pivotally supported keeper element, which is movable between unlatched, latched and release positions due to engagement with a catch plate. While prior structures of this type are generally of rugged construction and have the advantage of enclosing all operating or moving parts within a housing, they do, however, have the disadvantage of being relatively complex and thus expensive. Substantially less complex mechanisms have been devised, as evidenced for instance by U.S. Pat. No. 3,189,374, but this latter type of mechanism is believed to have the disadvantage of being readily susceptible to damage.

SUMMARY OF THE INVENTION

The present invention features an improved keeper mechanism for use in a touch latch mechanism and more particularly to a keeper mechanism, which combines the advantages of the mechanism disclosed in prior U.S. Pat. Nos. 2,941,831 and 3,189,374 without experiencing their disadvantages. More specifically, the keeper mechanism of the present invention retains the rugged construction of U.S. Pat. No. 2,941,831, wherein a housing serves to enclose a pivotally supported keeper element, while replacing the complex keeper element latching arrangement of such mechanism with a simple cam device of the general type described in U.S. Pat. No. 3,189,374. In accordance with the present invention, a pivotally supported keeper element includes an integrally formed resiliently deformable portion, which is engageable with a cam device, and the thickness or widthwise dimension of the housing is maintained at a minimum, as compared with that which would be required by direct substitution of the cam device illustrated in U.S. Pat. No. 3,189,374, by providing for controlled resilient deformation of the keeper element.

DRAWINGS

The nature and mode of operation of the present invention will now be more fully described in the following detailed description taken with the accompanying drawings wherein.

DETAILED DESCRIPTION

Figure 1:
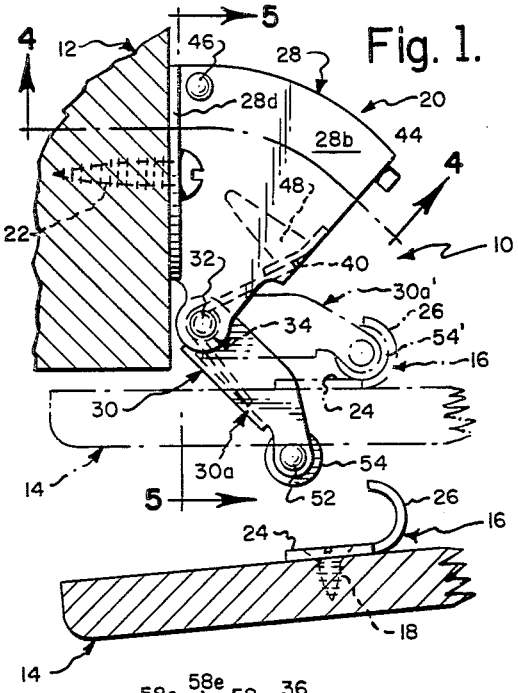
FIG. 1 is a top plan view showing a touch latch formed in accordance with the present invention mounted in association with a cabinet.

A touch latch formed in accordance with the present invention is generally designated as 10 in the drawings and shown in FIG. 1 for purposes of illustration as being mounted in association with a cabinet having a casing 12 and a door 14. Door 14 may be suitably supported for movement relative to casing 12, as by means of a hinge device, not shown, permitting swinging movements of the door about a vertical or other suitably arranged axis, between open or remote and closed or adjacent positions shown in solid and broken line, respectively, in FIG. 1.

Figure 2:
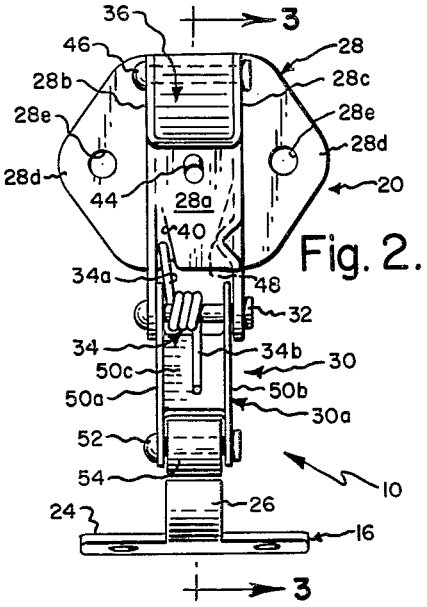
FIG. 2 is a front elevational view of the touch latch.

Touch latch 10 is shown in FIGS. 1 and 2 as generally comprising a latch plate 16 adapted to be suitably mounted on an inner surface of door 14, as by screw devices 18; and a keeper mechanism 20 adapted to be suitably mounted on casing 12, as by screw devices 22. Latch plate 16 may be considered as having a generally flat cam or operating portion 24 and a curled or latching end portion 26.

Figure 3:
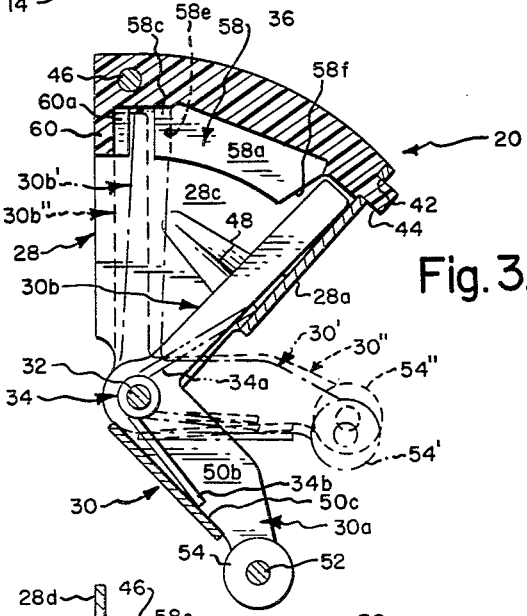
FIG. 3 is a sectional view taken generally along the line 3—3 in FIG. 2.

Keeper mechanism 20 is shown in FIGS. 1, 2, 3 and 5 as generally comprising a housing or mounting assembly 28; a keeper element 30, which is suitably supported on housing 28, as by a hinge pin 32, for pivotal movements between the door open, door closed or latched and door release positions designated by numerals 30, 30' and 30'', respectively, in FIG. 3; a coil spring 34, which is supported on hinge pin 32 with its opposite ends or legs **34*a* and 34*b* arranged to engage housing 28 and keeper element 30, respectively; and a keeper latching cam device 36**, which is operable to releasably latch the keeper element in its door latched position.

Housing 28 is shown as being stamped from sheet metal to define a generally U-shaped central portion having a front flange **28*a* joined to a pair of essentially parallel leg flanges 28*b* and 28*c*, and a pair of mounting flange portions 28*d* and 28*d*, which are joined one to each of the leg flanges and formed with openings 28*c* sized to receive screw devices 22. By referring to FIGS. 1–3 and 5, it will be seen that front flange 28*a* is deformed to define a locating recess 40 for positionally receiving leg 34*a* of coil spring 34 and is provided with an opening 42 sized to receive a mounting pin 44 formed integrally with cam device 36. Also, it will be understood that leg flanges 28*b* and 28*c* are formed with pairs of aligned openings sized to receive opposite ends of hinge pin 32 and a cam device mounting pin 46, whereas leg flange 28*c*** is additionally deformed to define an inwardly and forwardly inclined ramp or cam surface 48.

Figure 5:
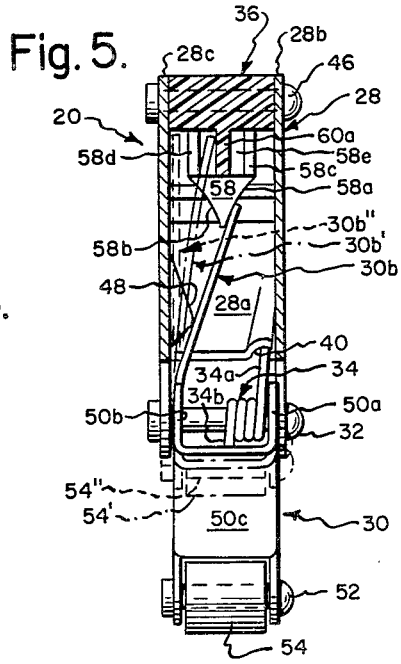
FIG. 5 is a sectional view taken generally along the line 5—5 in FIG. 1.

Keeper element 30 is best shown in FIGS. 2, 3 and 5 as being shaped to define a generally U-shaped operating or first end portion **30*a* having a pair of leg flanges 50*a* and 50*b* joined by a connecting flange 50*c*; and a latching or second end portion 30*b*, which is formed as an integral extension of leg flange 50*b* and extends in an essentially right angular relationship relative thereto. By referring to FIGS. 2 and 3, it will be understood that leg flanges 50*a* and 50*b* are formed with pairs of aligned openings for receiving opposite ends of hinge pin 32 and a bearing pin 52, which serves to rotatably support an operating/latching roller 54 arranged for operative engagement with latch plate 16. In the preferred construction of latch 10, keeper element 30 is formed of spring steel and latching end portion 30*b* is originally shaped to normally lie in an essentially coplanar relationship with leg flange 50*b***. As indicated above, primed and double primed members are employed in the drawing to designate the keeper element and its parts, when in door latched and released positions, respectively.

Figure 4:
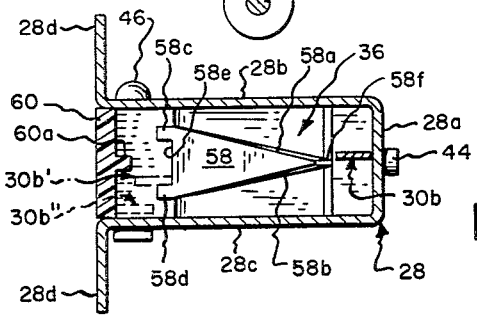
FIG. 4 is a sectional view taken generally along the line 4—4 in FIG. 1.

Cam device 36 is best shown in FIGS. 3–5 as being shaped to define a generally wedge shaped operating portion 58 having forwardly converging camming and clearance or return surfaces 58*a* and 58*b*, respectively, and a pair of essentially parallel and rearwardly projecting ribs 58*c* and 58*d*, which cooperate to bound a rearwardly opening notch or recess 58*e*; and a rearwardly disposed and transversely extending abutment or wall flange portion 60 having a forwardly projecting stop or rib 60*a* arranged intermediate ribs 58*c* and 58*d*. Preferably cam device 36 would be mold formed from a synthetic plastic material providing for minimum surface friction sliding contact between latching end portion 30*b* and camming surface 58*a*.

Referring particularly to FIGS. 3–5, it will be seen that the door open position of keeper element 30 is defined by engagement of latch end portion 30*b* with the inwardly facing surface of front flange 28*a* and ramp 48. When in door open position, latch end portion 30*b* is resiliently deformed by engagement with ramp 48, so that its free end is disposed to lie in alignment with cam surface 58*a*, but forwardly of the apex 58*f* defined by the juncture surfaces 58*a* and 58, as indicated in full line in FIGS. 4 and 5. During movement of door 14 between its open and closed positions, operating portion 24 of latch plate 16 is first brought into bearing engagement with roller 54 to initiate rearwardly directed pivotal movements of keeper element 30 against the return bias of spring 34 and bring the free end of latch end portion 30*b* into sliding engagement with cam surface 58*a*. Then, as closing movement of the door continues, roller 54 moves in engagement with operating portion 24 relatively towards latching end portion 26, latch end portion 30*b* is progressively deformed as it is forced to slide upwardly or rearwardly along cam surface 58*a* towards rib 58*c*. Incident to positioning of roller 54 in latching cooperation within latching end portion 26, latch end portion 30*b* rides off rib 58*c* and tends to automatically move under its own resilient bias transversely of housing 28 towards leg flange 28*c* for return to its non-deformed state. However, full return movement of latch end portion 30*b* is prevented, due to its engagement with rib 60*a*. When manual door closing pressure is released, spring 34 tends to return keeper element 30 towards its original or door open position, this serving to move latch end portion 30*b* forwardly for release from engagement with rib 60*a* and subsequent receipt in seated engagement within notch 58*c* to define the door latched position of keeper element 30; latch end portion 30*b* having moved under its own resilient bias into engagement with rib 58*d* immediately following its release from engagement with rib 60*a*, as indicated at 30*b*'. The design of touch latch 10 is such that roller 54 remains in latching engagement with latching end portion 26 for purposes of locking door 14 in closed position, when latch end portion 30*b* is captured within notch 58*c* to assume its door latched position in the manner best shown in FIG. 4.

When it is desired to release door 14 from its closed position, a slight finger pressure applied to the door will be sufficient to force latch end portion 30*b* to move rearwardly of notch 58*c* from engagement with rib 58*d*, whereby to free the latch end portion 30*b* for return to its non-deformed condition or door release position shown at 30*b*' in FIG. 5. Subsequently, when finger pressure on the door is released, spring 34 serves to return keeper element 30 to its previously described door open or unlatched position. It will be understood that during movements of the latch end portion towards its unlatched position, it slides in engagement with both cam surface 48 and clearance surface 58*b*; the cam surface engaging with its "root" end and serving to effect progressive resilient deformation thereof and the clearance surface engaging with its "free" end and serving to limit transverse displacements thereof, which would otherwise result from the influence of the cam surface. Accordingly, an "intermediate" portion of the latch end portion, which is disposed intermediate surfaces 48 and 58*b*, is resiliently deformed to assume a bowed configuration, i.e., to assume a concave shape opening towards leg flange 28*c*, as the latch end portion moves towards its unlatched position. Thus, when the "free" end of the latch end portion rides off clearance surface 58*b*, its "intermediate" portion is free to straighten and effect snap movement of the "free" end into alignment with cam surface 58*a*, as an incident to the return of the latch end portion to its unlatched position shown in FIGS. 3, 4 and 5.

In the illustrated construction, engagement of latch end portion 30*b* with abutment 60 serves to define the limit of door movement in a closing direction both during initial closing and subsequent release of the door.

I claim:

1. In a touch latch mechanism of the type adapted for use in latching a pair of members upon relative convergent movement thereof from a remote position into an adjacent position and for releasing said members from said adjacent position for relative divergent movement towards said remote position upon further movement of said members in the direction of said converging movement beyond said adjacent position, said touch latch mechanism including a catch plate carried by one of said members, and a keeper mechanism carried on the other of said members, said keeper mechanism including a housing fixed to said other of said members, a keeper element mounted in said housing for pivotal movement about an axis and having first and second end portions, said first end portion being engageable with said catch plate during said converging movement of said members, a spring subject to resilient deformation as said keeper element is pivoted upon engagement with said catch plate, and a latching device arranged in said housing for engagement with said second end portion of said keeper element upon pivotal movement thereof from an unlatched position incident to engagement of said first end with said catch plate for releasably retaining said keeper element in a latched position wherein said members are disposed in said adjacent position, said keeper element being movable into a release position relative to said latching device for return movement to said unlatched position under the bias of said spring incident to said further movement of said members, the improvement comprising in combination:

said second end portion of said keeper element is resiliently deformable in a direction aligned with said axis; and said latch device includes forwardly converging cam and clearance surfaces, a rearwardly opening notch and a rearwardly disposed abutment portion having a forwardly projecting stop generally aligned with said notch, said second end portion being disposed forwardly of said latch device and in alignment with said cam surface when in said unlatched position and being resiliently deformed incident to movement thereof rearwardly along said cam surface during latch plate induced pivotal movements of said keeper element, said second end portion tending to move between rearwardly disposed ends of said cam and clearance surfaces under its own bias, said stop constraining said second end portion for movement into said notch during movement of said second end portion between said rearwardly disposed ends to define said latched position, and said second end portion being moved out of said notch upon said further movement of said members to assume said release position permitting said spring to return said second end portion to said unlatched position.

2. The improvement according to claim 1, wherein said second end portion tends to assume an essentially undeformed state when in said release position and means carried by said housing effects resilient deformation of said second end portion incident to said return movement thereof between said release and unlatched positions.

3. The improvement according to claim 2, wherein said first end portion includes a pair of leg flanges joined by a connecting flange, said leg flanges being apertured to receive a hinge pin carried by said housing for supporting said keeper element for pivotal movement about said axis, and said second end portion is formed as an integral extension of one of said leg flanges and tends to assume an essentially coplanar relationship therewith when said second end portion is in said release position.

4. The improvement according to claim 3, wherein said means carried by said housing includes a ramp portion, said ramp portion and said clearance surface being arranged for engagement with root and free ends of said second end portion, respectively during said return movement, said root end connecting with said one of said leg flanges, engagement of said ramp portion with said root end tending to progressively deform same during said return movement sufficiently to place said free end in alignment with said cam surface upon return of said second end portion to said unlatched position, and engagement of said clearance surface with said free end, during said return movement, tending to bow an intermediate portion of said second end portion disposed intermediate said root and free ends, wherein said intermediate portion is free to straighten when said free end rides off said clearance surface and effect snap movement of said free end into alignment with said cam surface.

* * * * *